US008348707B2

(12) United States Patent
Ishikawa et al.

(10) Patent No.: US 8,348,707 B2
(45) Date of Patent: Jan. 8, 2013

(54) TERMINAL FITTING

(75) Inventors: Ryotaro Ishikawa, Yokkaichi (JP); Kazuaki Takeda, Yokkaichi (JP); Yutaka Noro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/181,618

(22) Filed: Jul. 13, 2011

(65) Prior Publication Data

US 2012/0034826 A1 Feb. 9, 2012

(30) Foreign Application Priority Data

Aug. 6, 2010 (JP) ..... 2010-177308

(51) Int. Cl.
*H01R 13/432* (2006.01)

(52) U.S. Cl. ..... 439/872; 439/744; 439/752

(58) Field of Classification Search ..... 439/744, 439/752, 871, 872
See application file for complete search history.

(56) References Cited

U.S. PATENT DOCUMENTS 6,976,874 B2 12/2005 Sakurai et al.
7,094,115 B2 * 8/2006 Noro et al. ..... 439/852
2003/0068932 A1 4/2003 Takatsuki et al.
2008/0146090 A1 6/2008 Shimizu
2008/0305681 A1 12/2008 Hiramatsu
2012/0034826 A1 * 2/2012 Ishikawa et al. ..... 439/733.1

FOREIGN PATENT DOCUMENTS

JP 10-040985 2/1998

* cited by examiner

*Primary Examiner* — James Harvey
(74) *Attorney, Agent, or Firm* — Gerald E. Hespos; Michael J. Porco

(57) ABSTRACT

A terminal fitting (10) has a rectangular tubular box (11) with an open rear end. A tab (12) extends forward from the box (11) and a crimping portion (14) is behind the box (11) for connection to a wire (30). The box (11) includes a base plate (15), two side plates (16) extending from opposite left and right sides of the base plate (15), and a supporting plate (17) extending from the side plates (16) substantially parallel to the base plate (15). The rear end of the supporting plate (17) defines a locking portion (18) to engage a locking lance (49). Only one restricting plate (22) extends from an extending end edge of a supporting plate (17) toward the base plate (15) substantially parallel to the side plates (16). A rear end (22R) of the restricting plate (22) is in the box (11) forward of the locking portion (18).

20 Claims, 8 Drawing Sheets

TERMINAL FITTING

BACKGROUND OF THE INVENTION

1. Field of the Invention

The invention relates to a terminal fitting.

2. Description of the Related Art

Japanese Unexamined Patent Publication No. H10-040985 discloses a male terminal fitting with a tubular box-shaped portion that has an open rear end. A tab extends forward from the box-shaped portion and a crimping portion extends back from the box-shaped portion. The crimping portion is to be connected to an end of a wire. The box-shaped portion has a base plate, two side plates that extend at substantially right angles from opposite sides of the base plate and two supporting plates that extend from extending ends of the side plates to be substantially parallel to the base plate. Restricting plates extend into the box-shaped portion from the extending ends of the supporting plates and are substantially parallel to the side plates.

Many terminal fittings of this type are bundled for storage and transport before being mounted into a connector housing. Thus, a tab of one terminal fitting inadvertently may be inserted into a box-shaped portion of another terminal fitting from behind. This insertion may cause the tab and the box-shaped portion to deform. However, the restricting plates in the box-shaped portion of the terminal fitting disclosed in Japanese Unexamined Patent Publication No. H10-040985 restrict entry of the tab of another terminal fitting into the box-shaped portion.

Two restricting plates are arranged side by side in a width direction in the above terminal fitting and may enlarge the box-shaped portion in the width direction.

The present invention was developed in view of the above situation and an object thereof is to allow miniaturization of a box-shaped portion.

SUMMARY OF THE INVENTION

The invention relates to a terminal fitting with a box-shaped portion. A tab extends forward from the box-shaped portion and a wire connection portion is arranged behind the box-shaped portion for connection to a wire. The terminal fitting is inserted into a connector housing and is retained from behind by a locking action of a retaining portion. The box-shaped portion includes a base plate, two side plates extending from the base plate and at least one supporting plate extending substantially parallel to the base plate. The rear end edge of the supporting plate defines a locking portion to be engaged with the retaining portion. Only one restricting plate extends from the extending end of the supporting plate toward the base plate and into the box-shaped portion. The existence of only one restricting plate in the box-shaped portion enables the box-shaped portion to be miniaturized in an arrangement direction of the side plates and the restricting plate.

The box-shaped portion preferably defines a substantially rectangular tube with an open rear end.

The side plates preferably extend substantially at right angles from the opposite left and right sides of the base plate.

The at least one supporting plate preferably extends from the extending end of at least one of the side plates.

The restricting plate preferably extends from the extending end of the supporting plate toward the base plate and is substantially parallel to the side plates. The rear end of the restricting plate preferably is located before the locking portion. Thus, the retaining portion and the restricting plate will not interfere with each other when the retaining portion is engaged with the locking portion.

The restricting plate may have a substantially L shape defined by a base panel connected directly to the supporting plate and extending toward the base plate and a restricting panel extending back from the base.

If cutouts are formed at the opposite front and rear ends of the restricting plate to bend the restricting plate with respect to the extending end edge of the supporting plate, a part between the locking portion at the rear end of the supporting plate and the rear cutout defines a cantilevered extension extending in a width direction. If a distance from the locking portion to the rear cutout in forward and backward directions is shorter than an extending distance of the cantilevered extension in the width direction, the cantilevered extension may be deformed by a reaction force from the retaining portion.

In this respect, the restricting plate has a substantially L shape in which the restricting portion extends back from the base. Thus, the rear end of the base directly connected to the supporting plate can be spaced a large distance from the rear end edge of the supporting plate. In this way, when the cutouts are formed at the opposite front and rear ends of the base panel, the cantilevered extension between the rear cutout and the locking portion is formed such that the distance in forward and backward directions is longer than the extending distance in the width direction and rigidity against the reaction force from the retaining portion is increased. Therefore, the cantilevered extension will not deform.

An end edge of the restricting panel facing the supporting plate preferably faces the supporting plate with a clearance smaller than the thickness of the tab. Thus, the tab will not enter the clearance between the restricting panel and the supporting plate.

An end edge of the restricting plate facing the base plate preferably faces the base plate with a clearance smaller than the thickness of the tab. Thus, the tab will not enter the clearance between the restricting plate and the base plate.

A front end of the box-shaped portion preferably is tapered so that the width and vertical dimension thereof are gradually reduced toward the front.

A receiving portion preferably is formed in an opening area of a locking hole by cutting and bending so that the opposite front and rear ends of the receiving portion are connected to the base plate. The receiving portion preferably is arranged in a widthwise intermediate position of the base plate and is accommodated at least partly in the box-shaped portion and bent when viewed sideways.

The supporting plate preferably has a single plate thickness and is formed by arranging two coplanar supporting panels side by side in the width direction.

An escaping recess preferably is formed at the extending end edge of at least one of the restricting plates for avoiding interference with the restricting plate.

Front and rear cutouts preferably are formed at the extending end edge of at least one of the supporting panels and extend substantially along the front and rear ends of the base panel. The cutouts suppress a projecting distance of the base panel from the extending end edge of the one supporting panel upon bending the base panel.

The tab preferably is wider than a vertical dimension between the lower surface of the base plate and the upper surface of the supporting plate of the box-shaped portion, and narrower than a width between the inner surfaces of the left and right side plates of the box-shaped portion.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENT

Figure 1:
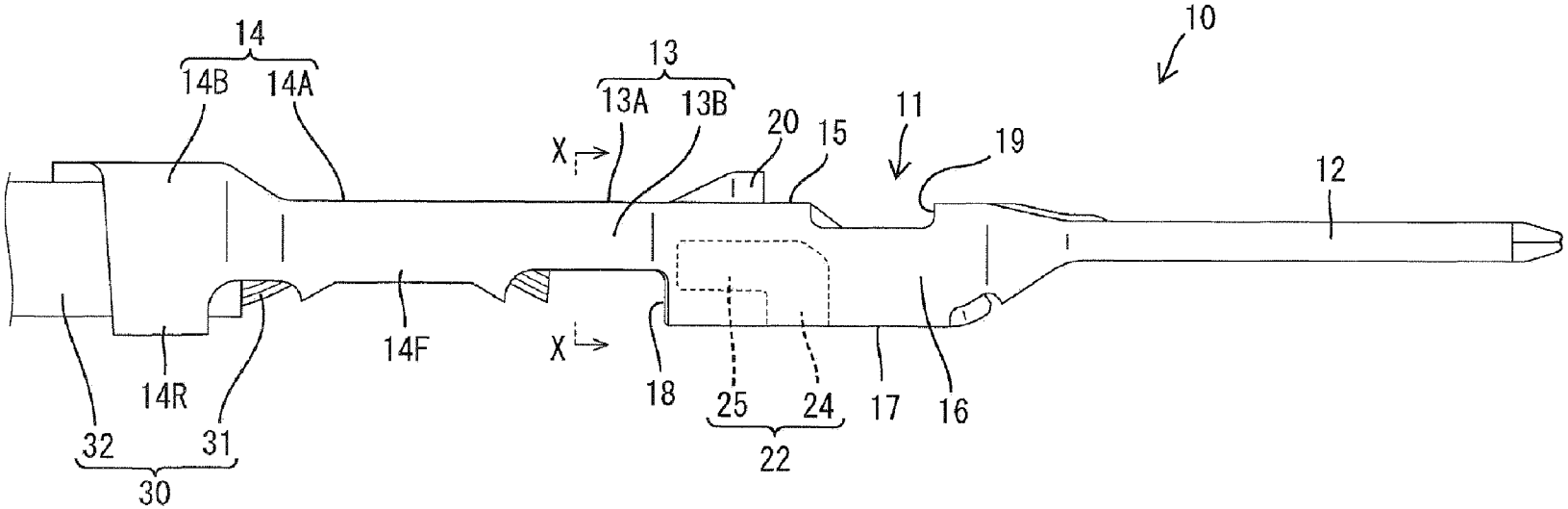
FIG. 1 is a side view of a terminal fitting according to one embodiment.

A terminal fitting in accordance with the invention is identified by the numeral 10 in FIGS. 1 to 8. The terminal fitting 10 is long and narrow in forward and backward directions and is formed by cutting or punching a conductive metal plate material into a shape shown in FIG. 8 and applying bending, hammering, cutting or the like to the plate. The terminal fitting 10 is a male terminal including a rectangular tubular box-shaped portion 11 with an open rear end. A tab 12 is cantilevered forward (right in FIGS. 1 to 3 and 6) from the front end of the box-shaped portion 11. A coupling 13 extends back from the rear end of the box-shaped portion 11 and a wire crimping portion 14 in the form of an open barrel extends back from the rear end of the coupling 13.

As shown in FIGS. 1 to 6, the box-shaped portion 11 is formed into a substantially rectangular tube with a base plate 15, two bilaterally symmetric side plates 16 extending down at substantially right angles from the opposite left and right sides of the base plate 15, and a supporting plate 17 extending between the extending ends of the left and right side plates 16 substantially parallel to the base plate 15. A front part of the box-shaped portion 11 is tapered so that the width and vertical dimensions are reduced gradually toward the front. The rear edge of the supporting plate 17 defines a locking portion 18.

Figure 2:
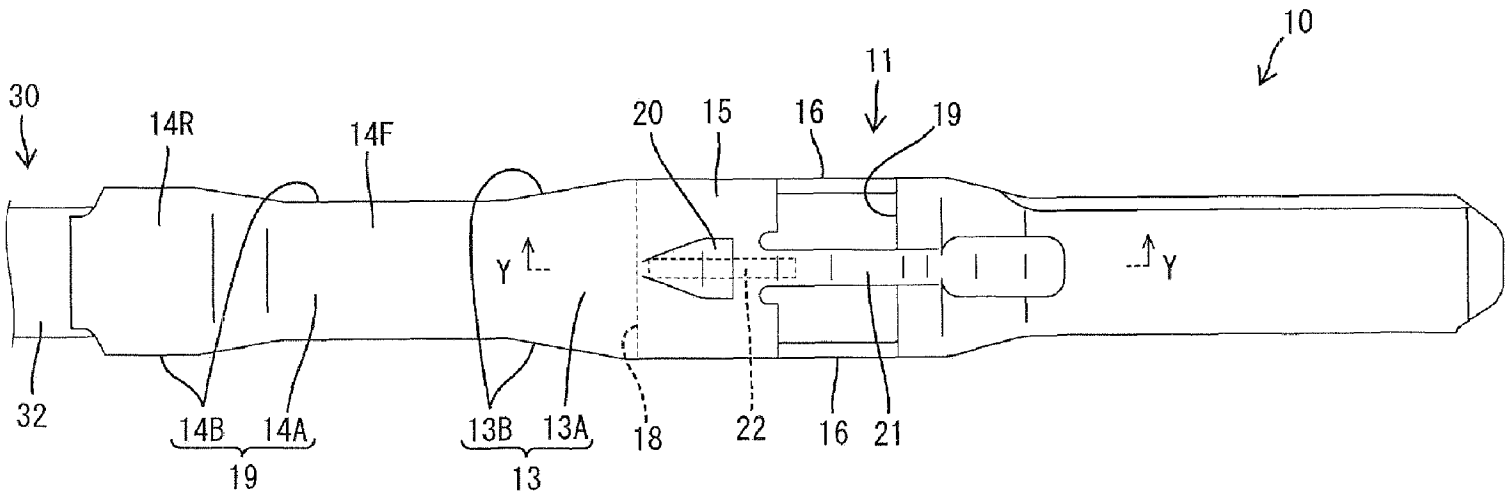
FIG. 2 is a plan view of the terminal fitting.
Figure 5:
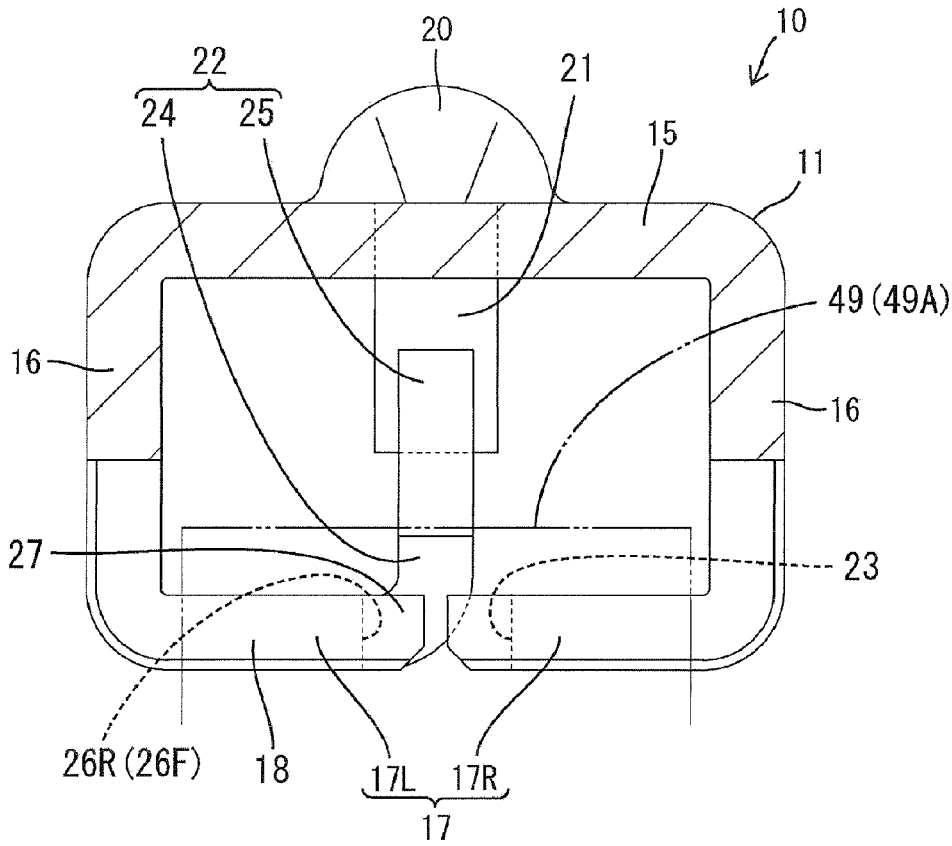
FIG. 5 is a section along X-X of FIG. 1.
Figure 6:
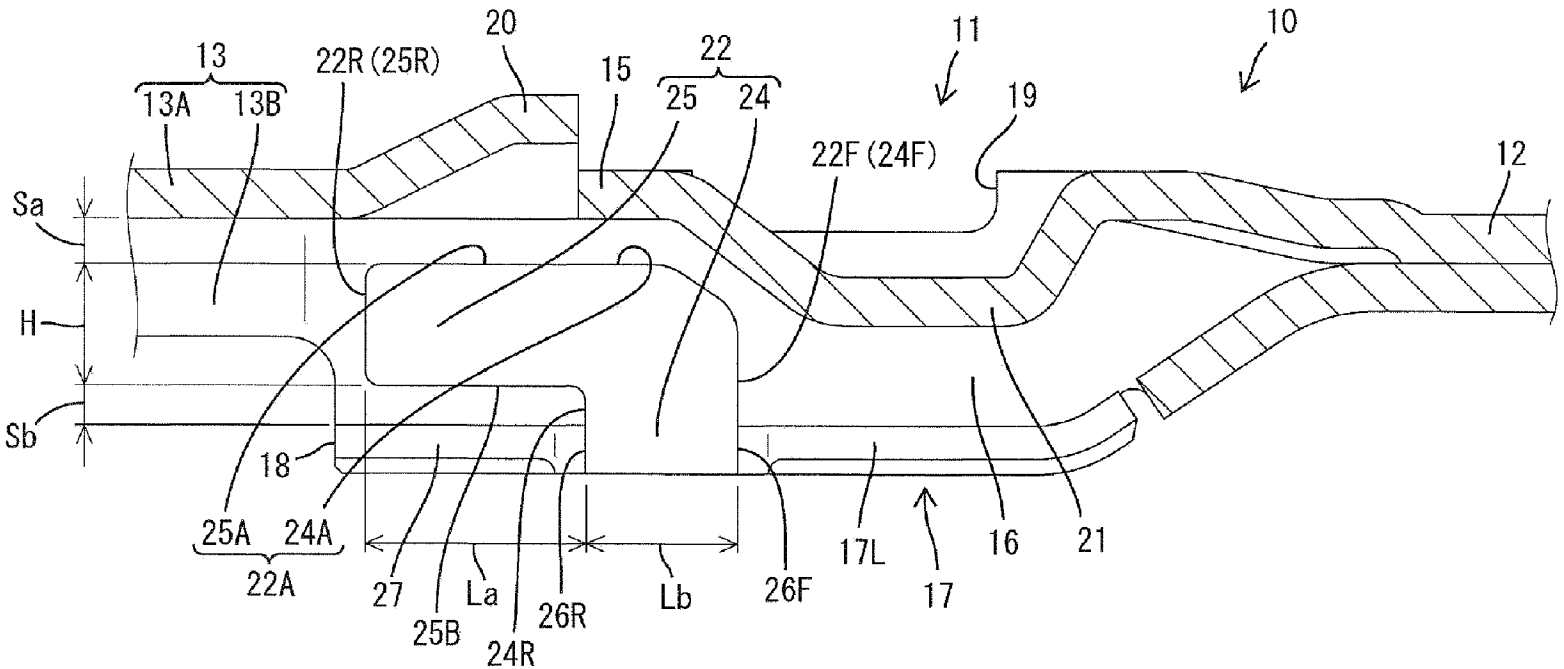
FIG. 6 is a section along Y-Y of FIG. 2.

As shown in FIGS. 2, 5 and 6, a rectangular locking hole 19 is formed in a substantially central area of the base plate 15 in forward and backward directions and extends over substantially the entire width of the base plate 15. The base plate 15 also is shaped or hammered to form a stabilizer 20 that projects out at an area behind the locking hole 19. The stabilizer 20 prevents the terminal fitting 10 from being inserted into a cavity 44 in an incorrect posture (e.g. vertically inverted or laterally inclined by)90°.

As shown in FIGS. 2 and 6, a long narrow receiving portion 21 is formed in an opening area of the locking hole 19 and has opposite front and rear ends extending unitarily from the base plate 15. The receiving portion 21 is in a substantially widthwise center of the base plate 15 and is bent when viewed sideways to extend into the box-shaped portion 11. A tab 12 of another terminal fitting 10 may try to enter the box-shaped portion 11 through the locking hole 19. However the receiving portion 21 will contact the tab to prevent any further entry.

Figure 4:
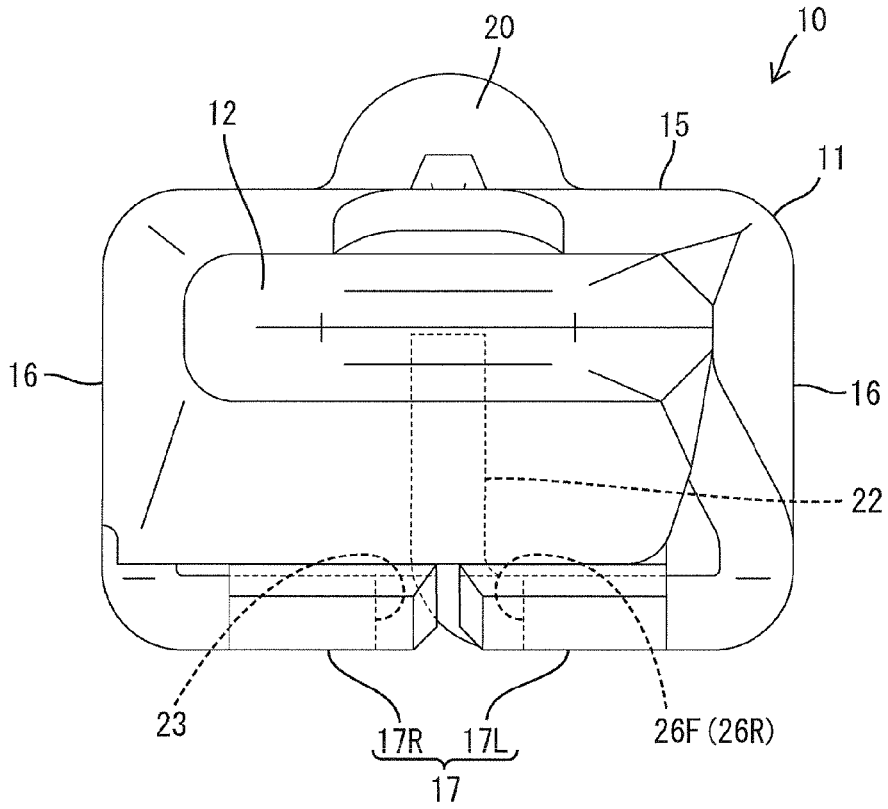
FIG. 4 is a front view of the terminal fitting.
Figure 8:
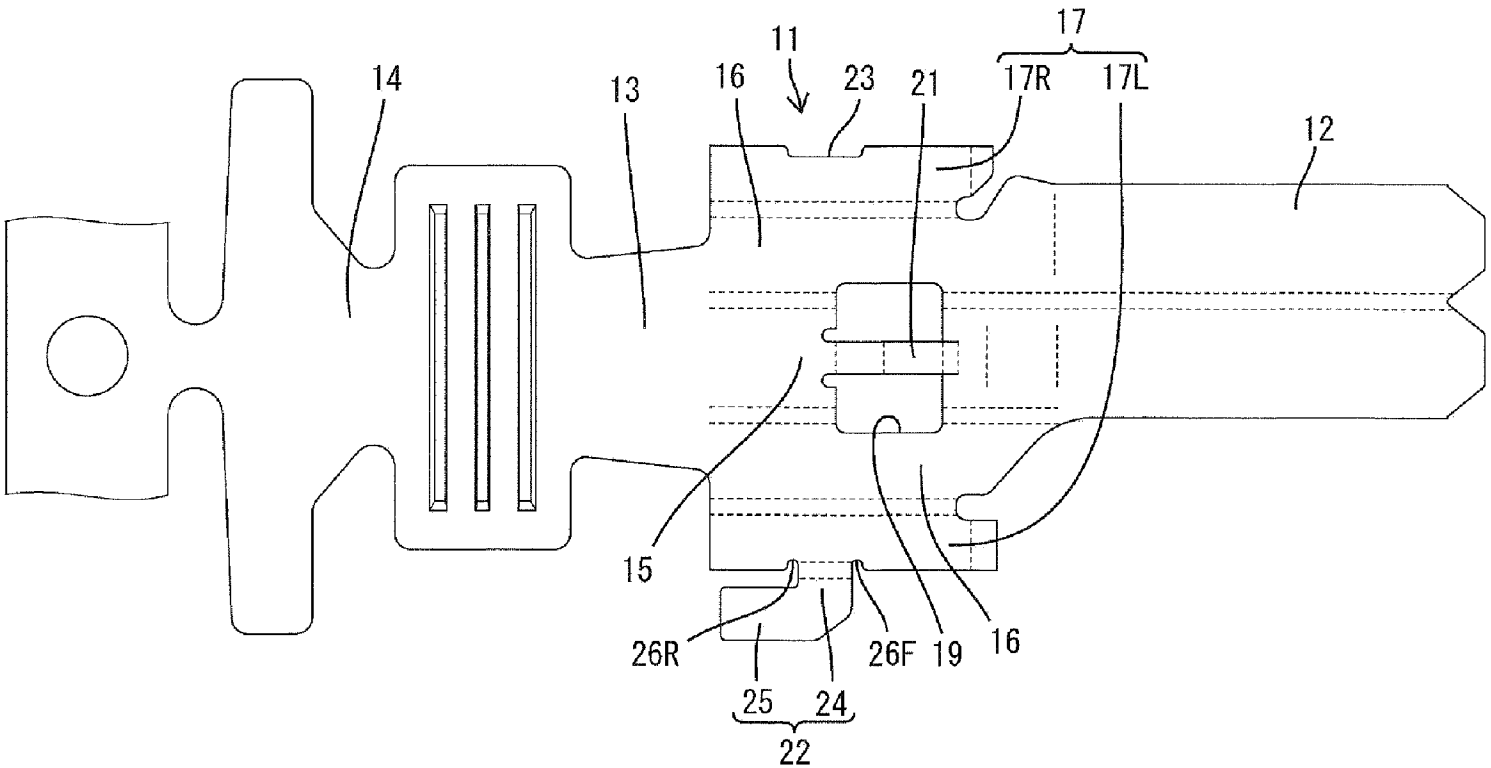
FIG. 8 is a development view of the terminal fitting.

As shown in FIGS. 4, 6 and 8, the tab 12 is formed from a plate that extends from the front end of the base plate 15. The plate that forms the tab 12 is folded along a folding line that extends in forward and backward directions so that upper and lower parts are placed one over the other. The tab 12 is wider than a vertical dimension between the lower surface of the base plate 15 and the upper surface of the supporting plate 17 of the box-shaped portion 11, but is narrower than a width between the inner surfaces of the left and right side plates 16 of the box-shaped portion 11. Further, the thickness of the tab 12 is smaller than the width of the tab 12 and smaller than a distance between the lower surface of the base plate 15 and the upper surface of the supporting plate 17 of the box-shaped portion 11. Thus, the tab 12 is dimensioned to be insertable into a box-shaped portion 11 of another terminal fitting 10 from behind.

As shown in FIGS. 1 to 3 and 6, the coupling 13 is composed of a first coupling portion 13A substantially continuous and flush with the rear end of the base plate 15 and two second coupling portions 13B extending down from opposite left and right sides of the first coupling 13A and substantially normal to the first coupling portion 13A. Additionally, the second coupling portions 13B are connected to the rear ends of the side plates 16. Vertical dimensions of the second coupling portions 13B from the first coupling portion 13A are less than the vertical dimensions of the side plates 16. Thus, a space is ensured behind the locking portion 18 at the rear end of the supporting plate 17 and behind the rear ends of lower areas of the side plates 16 of the box-shaped portion 11.

Figure 3:
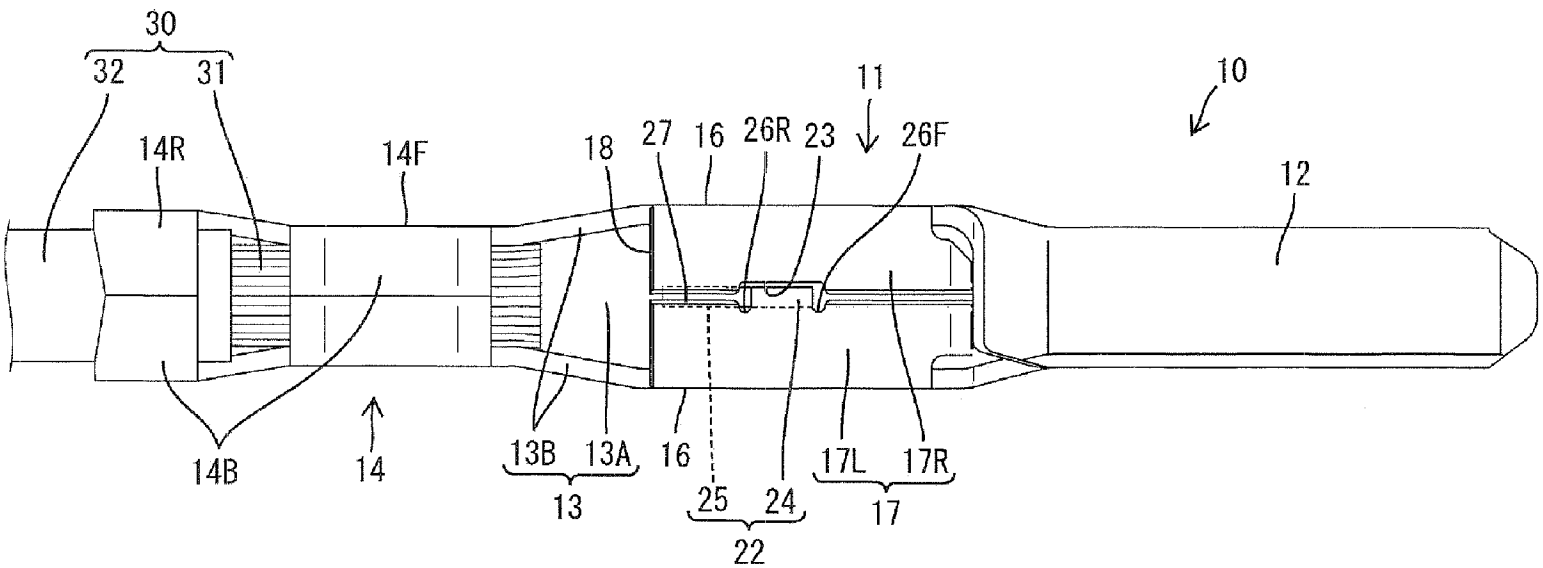
FIG. 3 is a bottom view of the terminal fitting.

As shown in FIGS. 1 to 3, the crimping portion 14 has a receiving plate 14A extending unitarily to the rear end of the first coupling 13A and crimping pieces 14B extending down from the opposite left and right sides of the receiving plate 14A. A wire barrel 14F at the front end of this crimping portion 14 is to be crimped, bent, folded or deformed to connect electrically conductively to a conductor 31 exposed at a front end portion of a wire 30 by removing an insulation coating 32. An insulation barrel 14R at the rear of the crimping portion 14 is crimped, bent, folded or deformed into connection with an area of the wire 30 covered by the insulation coating 32.

Figure 7:
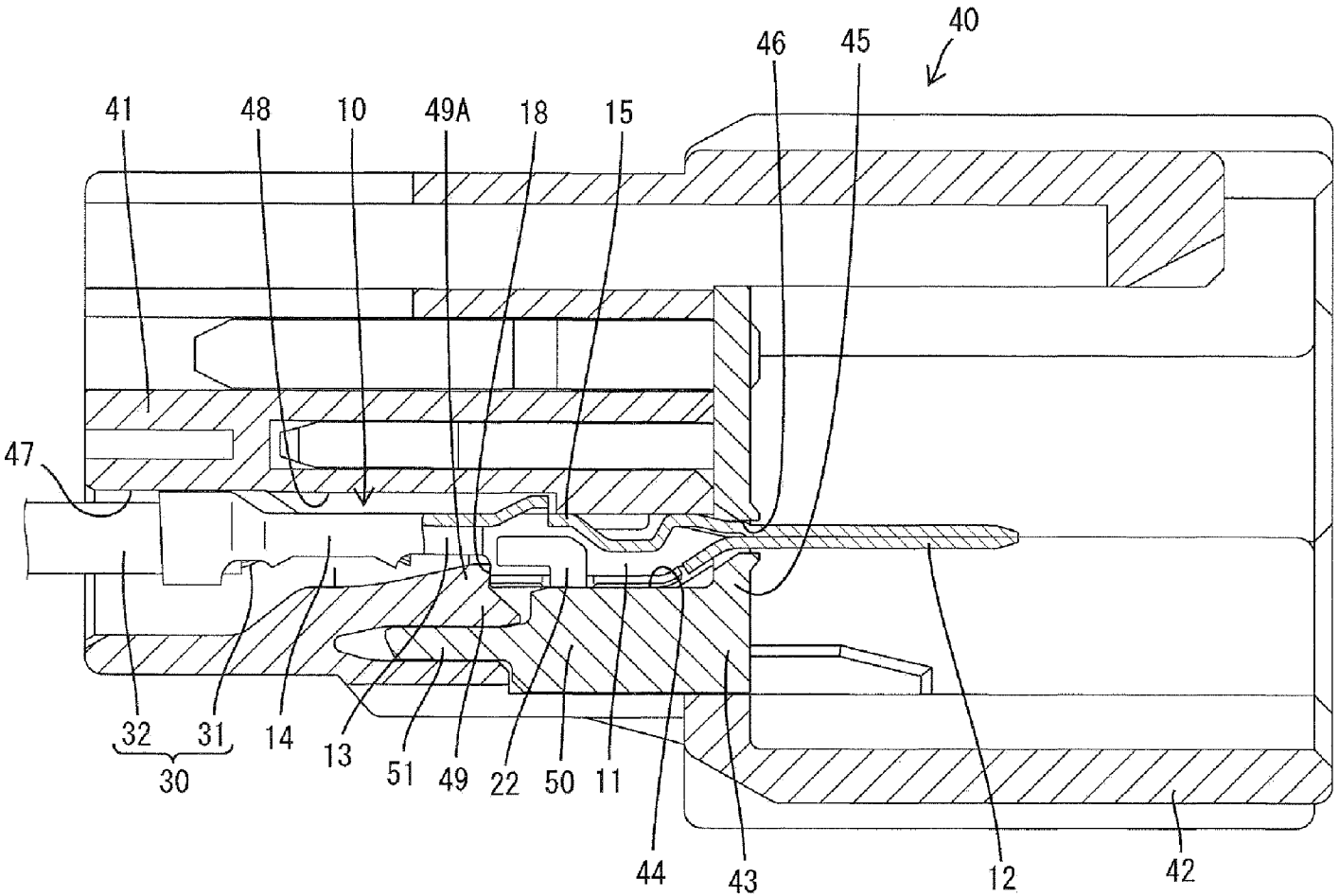
FIG. 7 is a section showing a state where the terminal fitting is mounted in a connector housing.

The terminal fitting 10 is used with a connector housing 40 that is molded unitarily of synthetic resin. The housing 40 has a substantially block-shaped terminal holding portion 41 and a receptacle 42 extends forward from the terminal holding portion 41. A front retainer 43 is mounted into the terminal holding portion 41 from the front, as shown in FIG. 7. Cavities 44 penetrate the terminal holding portion 41 in forward and backward directions and the front retainer 43 is mounted therein. Front walls 45 of the cavities 44 are formed, at least partly, by the front retainer 43 and have small through holes 46 for allowing the insertion of the tabs 12. Large terminal insertion holes 47 are formed in the rear ends of the cavities 44. An escaping groove 48 is formed in an upper wall of each cavity 44 for receiving the stabilizer 20 of the terminal fitting 10.

A locking lance 49 is cantilevered forward along the bottom wall of each cavity 44, and a retaining projection 49A projects from each locking lance 49 toward the cavity 44. The locking lance 49 normally is held at a locking position where the retaining projection 49A is in the cavity 44, as shown in FIG. 7. However, the locking lance 49 is resiliently deformable to a retracted position (not shown) where the retaining projection 49A is retracted from the cavity 44 and from the insertion path for the terminal fitting 10. As shown in FIG. 5, the locking lance 49 and the retaining projection 49A are slightly narrower than the box-shaped portion 11.

The front retainer 43 is movable between a retaining position shown in FIG. 7 and a retracted position (not shown) located before the retaining portion. The front retainer 43 is formed with the front wall 45, a main portion 50 constituting outer parts of front parts of the cavities 44 and holding portions 51 extending back from the main portion. The holding portions 51 are retracted from the deformation spaces for the locking lances 49 when the front retainer 43 is at the retracted position so that the locking lances 49 can deform resiliently from the locking position to the retracted position. The holding portions 51 are in the deformation spaces when the front retainer 43 is at the retaining position to prevent deformation of the locking lances 49 and hold the locking lances 49 at the locking position.

The terminal fitting 10 is inserted into the housing 40 while the front retainer 43 is at the retracted position. The box-shaped portion 11 contacts the retaining projection 49A during the insertion process and resiliently deforms the locking lance 49 to the retracted position. The box-shaped portion 11 contacts the front wall 45 to stop at its proper front end position and the locking lance 49 resiliently returns so that the retaining projection 49A engages the locking portion 18 from behind to retain the terminal fitting 10.

A multitude of terminal fittings 10 are bundled, stored and transported before being mounted into the housing 40. The rear of the box-shaped portion 11 is open, and a tab 12 of another terminal fitting 10 may possibly inadvertently enter the box-shaped portion 11 from behind. This engagement could deform the tab 12 and the box-shaped portion 11. As a countermeasure, the terminal fitting 10 has means for restricting entry of the tab 12 into the box-shaped portion 11 in this embodiment.

As shown in FIGS. 3 to 5, the supporting plate 17 includes a left panel 17L extending from the left side plate 16 and a right panel 17R extending from the right side plate 16. The widths of the left and right panels 17L, 17R each are about ½ the width of the box-shaped portion 11. Thus, the extending ends of the left and right panels 17L, 17R butt against each other or proximately face each other. Accordingly, the supporting plate 17 has the left and right panels 17L, 17R coplanar and side by side in the width direction.

As shown in FIGS. 3 to 6, a restricting plate 22 extends up at a substantially right angle from the extending end of the left panel 17L so that the restricting plate 22 is substantially parallel to the side plates 16. This restricting plate 22 defines the means for restricting the entrance of the tab 12 of another terminal fitting 10 into the box-shaped portion 11. The restricting plate portion 22 is at a position slightly behind the center of the left plate 17L in forward and backward directions. Further, the restricting plate 22 is at a center of the box-shaped portion 11 in the width direction. That is, as shown in FIG. 5, a center of the restricting plate 22 in a thickness direction substantially coincides with a boundary position between the left and right panels 17L, 17R in the width direction. A clearance between the left and right panels 17L, 17R is narrower than the thickness of the restricting plate 22. Thus, an escaping recess 23 is formed at the extending end edge of the right restricting panel 17R for avoiding interference with the restricting plate 22.

As shown in FIGS. 4-6, the restricting plate 22 is substantially planar and comprises a base panel 24 connected directly to the left panel 17L and a restricting panel 25 extending back from and coplanar with the base panel 24 to define a substantially L-shaped when viewed sideways. A rear end 22R of the restricting plate 22 (rear end edge 25R of the restricting panel 25) is located before the locking portion 18 in forward and backward directions. Thus, the restricting plate 22 is located entirely before the locking portion 18 and is in the box-shaped portion 11. Distances between the restricting plate 22 and the side plates 16 in the width direction are shorter than the width of the tab 12.

The base panel 24 is substantially rectangular when viewed sideways. As shown in FIGS. 3 and 6, front and rear cutouts 26F, 26R are formed at the extending end edge of the left panel 17L and extend substantially along the front and rear ends of the base panel 24. The cutouts 26F, 26R suppress a projecting distance of the base panel 24 from the extending end edge of the left panel 17L upon bending the base panel 24. Thus, the cutouts 26F, 26R reduce a clearance between the extending end edges of the left and right panels 17L, 17R in the width direction and, simultaneously, reduce a recessed dimension of the escaping recess 23 formed in the right panel 17R. As shown in FIG. 6, except at its upper end portion, the front end edge 22F of the restricting plate 22 (front edge 24F of the base panel 24) is substantially straight and perpendicular to forward and backward directions. A rear edge 24R of the base panel 24 extending from the supporting plate 17 to the restricting panel 25 also is substantially straight and perpendicular to forward and backward directions similar to the front edges 22F, 24F.

The restricting panel 25 is substantially rectangular when viewed sideways and, as shown in FIG. 6, an upper edge 25A (end edge facing the base 15) of the restricting panel 25 is connected linearly to an upper edge 24A (edge facing the base plate 15) of the base 24 except at its front end and forms an upper edge 22A of the restricting plate 22. The upper edge 22A of this restricting plate 22 extends substantially parallel to the base plate 15 (i.e. in forward and backward directions) and is separated from the base plate 15 by a distance Sa shorter than the thickness of the tab 12. Additionally, the upper edge 22A of the restricting plate 22 is located above the lower edge of the second coupling plate 13B of the coupling 13.

A lower edge 25B of the restricting portion 25 faces the supporting plate 17 and is substantially parallel to the supporting plate 17 while being separated from the supporting plate 17 by a distance Sb that is shorter than the thickness of the tab 12. The lower edge 25B of the restricting portion 25 is below the lower edge of the second coupling portion 13B of the coupling 13. A rear edge 25R of the restricting portion 25 (rear edge 22R of the restricting panel 22) is substantially straight and perpendicular to forward and backward directions, similar to the front end edge 24F of the base 24. A dimension La of the restricting portion 25 in forward and backward directions is larger than a dimension H thereof in the vertical direction (direction parallel to an extending direction of the restricting panel 22 toward the base panel 15) and/or larger than a dimension Lb of the base portion 24 in forward and backward directions.

The tab 12 of another terminal fitting 10 may try to enter the box-shaped portion 11 from behind. However, the above-described restricting plate 22 ensures that the leading end of the tab 12 contacts the rear edge 22R of the restricting plate 22 (rear edge 25R of the restricting panel 25) upon slightly entering, thereby preventing any further entrance of the tab 12. As a result, neither the tab 12 nor the box-shaped portion 11 will deform.

Only one restricting plate 22 is accommodated in the box-shaped portion 11. Thus, the box-shaped portion 11 can be miniaturized in a width direction of the side plates 16 and the restricting plate 22. Further, the rear edge 22R of the restricting plate 22 is before the locking portion 18. Thus, the locking lance 49 and the restricting plate 22 will not interfere with each other when the locking portion 18 engages the locking lance 49.

The cutouts 26F, 26R are formed at opposite front and rear ends of the base panel 24 directly connected to the left panel 17L to bend the restricting plate 22 with respect to the extending end edge of the left panel 17L of the supporting plate 17, and a part between the locking portion 18 at the rear end of the left panel 17L and the rear cutout 26R defines an extension 27 cantilevered in the width direction. If a distance from the locking portion 18 to the rear cutout 26R in forward and backward directions is shorter than an extending distance of the cantilevered extension 27 in the width direction, the cantilevered extension 27 may be deformed by a reaction force from the locking lance 49.

In this respect, the restricting plate 22 has a substantially L shape with the restricting panel 25 extending back from the base panel 24. Thus, the rear end of the base panel 24 is connected to the left panel 17L and can be separated from the rear edge of the supporting plate 17 (locking portion 18). In this way, the cantilevered extension 27 between the rear cutout 26R and the locking portion 18 is formed so that the distance in forward and backward directions is longer than the extending distance in the width direction. Thus, rigidity against the reaction force from the locking lance 49 is increased and the reaction force from the locking lance 49 will not deform the cantilevered extension 27.

The distance Sb between the lower edge 25B of the restricting panel 25 and the supporting plate 17 is made shorter than the thickness of the tab 12. Thus, the tab 12 will not enter the clearance between the restricting panel 25 and the supporting plate 17. Further, since the distance Sa between the upper edge 22A of the restricting plate 22 and the base plate 15 is shorter than the thickness of the tab 12. Thus, the tab 12 will not enter the clearance between the restricting plate 22 and the base plate 15.

The invention is not limited to the above described and illustrated embodiment. For example, the following embodiments also are included in the scope of the invention.

The upper edge of the restricting plate is separated from the base plate by a relatively long distance in a range smaller than the thickness of the tab in the above-described embodiment, but it may face the base plate with a tiny clearance formed therebetween or may be in contact with the base plate.

The distance between the upper edge of the restricting plate and the base plate is shorter than the thickness of the tab in the above embodiment, but it may exceed the thickness of the tab.

The lower edge of the restricting panel of the restricting plate is separated from the supporting plate by a relatively long distance in a range smaller than the thickness of the tab in the above-described embodiment, but it may face the supporting plate with a tiny clearance or may contact with the supporting plate.

The lower edge of the restricting panel of the restricting plate and the supporting plate is shorter than the thickness of the tab in the above embodiment, but it may exceed the thickness of the tab.

The restricting panel is longer in forward and backward directions is longer than in the vertical direction in the above embodiment, but it may be equal to or shorter than the vertical dimension of the restricting panel.

The length of the restricting panel in forward and backward directions exceeds the length of the base panel in forward and backward directions in the above embodiment, but it may be equal to or shorter than the dimension of the base panel in forward and backward directions.

The front edge of the restricting plate is substantially straight and perpendicular to forward and backward directions in the above-described embodiment, but it may be straight in a direction oblique to forward and backward directions or may be nonlinear.

The rear edge of the base panel of the restricting plate is substantially straight and perpendicular to forward and backward directions in the above embodiment, but it may be straight and oblique to forward and backward directions or may be nonlinear.

The rear edge of the restricting panel of the restricting plate is substantially straight and perpendicular to forward and backward directions in the above embodiment, but it may be straight and oblique to forward and backward directions or may be nonlinear.

The upper edge of the restricting plate is substantially straight and parallel to forward and backward directions in the above embodiment, but it may extend straight and oblique to forward and backward directions or may be nonlinear.

The lower edge of the restricting panel of the restricting plate is substantially straight and parallel to forward and backward directions in the above embodiment, but it may extend straight and oblique to forward and backward directions or may be nonlinear.

The upper edges of the base panel and the restricting panel are substantially collinear in the above embodiment, they may be offset.

The restricting plate has a substantially L shape defined by the substantially rectangular base panel directly connected to the supporting panel and extending toward the base plate and the substantially rectangular restricting panel extending back from the base panel in the above embodiment. However, it may have a rectangular shape, the dimension of which in forward and backward directions is constant over the entire length in the extending direction toward the base panel.

The restricting plate is arranged in the widthwise center in the above embodiment, but it may be to the left or right from the widthwise center position.

The supporting plate comprises the left and right panels, but it may comprise a single plate. In this case, an extension of the supporting plate may be folded closely substantially to the widthwise center and the restricting plate may extend from this closely folded portion.

The extending ends of the two panels of the supporting plate butt against each other. Instead, a first of the two panels may be formed to extend over the entire width of the box-shaped portion, the second panel may be narrower than the entire width of the box-shaped portion and placed on the inner surface of the first panel, and the restricting plate may extend from the extending end of the second panel.

The retaining portion is the locking lance that is formed unitarily to the inner wall of the cavity in the above embodiment. However, the invention is also applicable in the case where the retaining portion is a retainer to be mounted into the housing. In this case, the locking lance formed at the inner wall of the cavity is engaged with a lance hole.

What is claimed is:

1. A terminal fitting, comprising:

a box;

a tab substantially extending forward from the box; and a wire connection portion behind the box and configured to be connected to a wire; wherein:

the box includes a base plate, two side plates extending from the base plate, and at least one supporting plate extending substantially parallel to the base plate;

a rear end edge of the supporting plate defining a locking portion to be engaged with a retaining portion; and only one restricting plate extending from an extending end edge of the supporting plate toward the base plate and into the box, wherein a rear end of the restricting plate is forward of the locking portion.

2. The terminal fitting of claim 1, wherein the box is a substantially rectangular tube with an open rear end.

3. The terminal fitting of claim 1, wherein the side plates extend at substantially right angles from opposite left and right sides of the base plate.

4. The terminal fitting of claim 1, wherein the at least one supporting plate extends from an end of at least one of the side plates opposite the base plate.

5. The terminal fitting of claim 1, wherein the restricting plate extends from an extending end of the supporting plate toward the base plate substantially parallel to the side plates.

6. A terminal fitting comprising:

a box including a base plate, two side plates extending from the base plate, and at least one supporting plate extending substantially parallel to the base plate, a rear end edge of the supporting plate defining a locking portion to be engaged with a retaining portion, the base plate being formed with a locking hole and only one restricting plate extending from an extending end edge of the supporting plate toward the base plate and into the box, the base plate being formed with a locking hole;

a tab substantially extending forward from the box;

a wire connection portion behind the box and configured to be connected to a wire; and a receiving portion having opposite front and rear ends connected to the base plate forward and rearward of the locking hole and an intermediate portion projecting into the box-shaped portion at the locking hole.

7. The terminal fitting of claim 1, wherein the restricting plate has a substantially L shape with a base panel directly connected to the supporting plate and extending toward the base plate and a restricting panel extending backward from the base panel.

8. The terminal fitting of claim 7, further comprising front and rear cutouts are formed at an extending end edge of at least one of the panels adjacent front and rear ends of the base panel of the restricting plate to suppress a projecting distance of the base panel from the extending end edge of the panel of the supporting plate upon bending the base panel.

9. The terminal fitting of claim 1, wherein an end edge of the restricting plate faces the supporting plate with a clearance formed therebetween that is smaller than a thickness of the tab.

10. The terminal fitting of claim 1, wherein an end edge of the restricting plate substantially faces the base plate with a clearance formed therebetween that is smaller than the thickness of the tab.

11. The terminal fitting of claim 1, wherein a front end portion of the box-shaped portion is tapered to have width and vertical dimensions that are reduced gradually reduced toward the front.

12. The terminal fitting of claim 6, wherein a rear end of the restricting plate is forward of the locking portion.

13. The terminal fitting of claim 6, wherein the receiving portion is at a widthwise intermediate position of the base plate.

14. The terminal fitting of claim 1, wherein the supporting plate comprises first and second coplanar panels.

15. The terminal fitting of claim 14, wherein an escaping recess is formed at an extending end edge of at least one of the panels of the supporting plate for avoiding interference with the restricting plate.

16. The terminal fitting of claim 1, wherein a width of the tab exceeds a dimension between opposed surfaces of the base plate and the supporting plate of the box-shaped portion, and is less than a distance between the left and right side plates of the box-shaped portion.

17. A terminal fitting having opposite front and rear ends, a tab adjacent the front end, a wire connection portion substantially adjacent the rear end and a substantially rectangular tubular box between the tab and the wire connection portion, the box having an open rear end and comprising:

a base plate having opposite first and second sides;

substantially parallel first and second side plates extending respectively from first and second sides of the base plate;

first and second supporting panels extending respectively from ends of the first and second side plates remote from the base plate, the supporting panels being substantially coplanar with one another and substantially parallel to the base plate, the second supporting panel having a free edge adjacent the first supporting panel; and a restricting plate extending from an end of the first supporting plate adjacent the second supporting plate and projecting toward the base plate and into the box.

18. The terminal fitting of claim 17, wherein the restricting plate is substantially parallel to the side plates.

19. The terminal fitting of claim 18, wherein a rear end of the restricting plate is forward of a rear end of the box.

20. The terminal fitting of claim 19, wherein the restricting plate has a substantially L shape with a base panel directly connected to the first supporting panel and extending toward the base plate and a restricting panel extending backward from the base panel.

* * * * *